US009038858B2

(12) United States Patent
Hanai et al.

(10) Patent No.: US 9,038,858 B2
(45) Date of Patent: May 26, 2015

(54) AEROSOL DEVICE FOR ALLOCATION OF PLURALITY OF FLUIDS

(75) Inventors: Nobuyuki Hanai, Chiyoda-ku (JP); Ken Ogata, Chiyoda-ku (JP)

(73) Assignee: TOYO AEROSOL INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 13/496,028

(22) PCT Filed: Mar. 10, 2010

(86) PCT No.: PCT/JP2010/001685

§ 371 (c)(1),
(2), (4) Date: Mar. 14, 2012

(87) PCT Pub. No.: WO2011/067868

PCT Pub. Date: Jun. 9, 2011

(65) Prior Publication Data

US 2012/0168463 A1 Jul. 5, 2012

(30) Foreign Application Priority Data

Dec. 1, 2009 (JP) ..... 2009-273757

(51) Int. Cl.

| | |
|---|---|
| ***B65D 83/14*** | (2006.01) |
| ***B65D 83/62*** | (2006.01) |
| ***B65D 83/68*** | (2006.01) |
| ***B65D 83/38*** | (2006.01) |

(52) U.S. Cl.

CPC ..... *B65D 83/62* (2013.01); *B65D 83/68* (2013.01); *B65D 83/38* (2013.01)

(58) Field of Classification Search

CPC ..... B65D 83/38; B65D 83/54; B65D 83/62; B65D 83/68

USPC ..... 222/95, 105, 635, 94, 386.5, 389, 136, 222/137, 402.1, 402.24, 135, 402.2, 542; 128/200.23

See application file for complete search history.

(56) References Cited

U.S. PATENT DOCUMENTS

| | | | | |
|---|---|---|---|---|
| 2,763,402 | A * | 9/1956 | Livingstone | 222/109 |
| 2,781,954 | A * | 2/1957 | Bretz, Jr. | 222/402.2 |
| 2,900,114 | A * | 8/1959 | Utz | 222/402.24 |
| 2,941,696 | A * | 6/1960 | Homm | 222/136 |
| 3,176,890 | A * | 4/1965 | Potapenko et al. | 222/402.2 |

(Continued)

FOREIGN PATENT DOCUMENTS

| | | |
|---|---|---|
| JP | 60-070566 | 5/1985 |
| JP | 2002-193363 | 7/2002 |

(Continued)

*Primary Examiner* — Paul R Durand
*Assistant Examiner* — Charles P Cheyney
(74) *Attorney, Agent, or Firm* — Jordan and Hamburg LLP

(57) ABSTRACT

An aerosol device is provided with a set of two aerosol valves in an inch bead portion of an aerosol container, and different contents are separately packed in the aerosol container without being mixed. The different contents are separately introduced into the set of two aerosol valves, and the stem insertion portions of housings of the set of two aerosol valves project above the inch bead portion. The lower end of a fitting member whose inner peripheral shape corresponds to the outer peripheral shape of the set of two housings is fitted and fixed to the inner periphery of the inch bead portion. The outer periphery of the fitting member is covered with a cover, and the lower end of the cover is fixed to the outer periphery of the inch bead portion.

7 Claims, 10 Drawing Sheets

(56) References Cited

U.S. PATENT DOCUMENTS

| | | | | |
|---|---|---|---|---|
| 3,672,543 | A * | 6/1972 | Roper et al. | 222/183 |
| 5,697,532 | A * | 12/1997 | Wilde et al. | 222/402.16 |
| 6,092,566 | A * | 7/2000 | Yazawa et al. | 141/20 |
| 6,315,173 | B1 * | 11/2001 | Di Giovanni et al. | 222/402.2 |
| 6,419,168 | B1 * | 7/2002 | Thieleke et al. | 239/337 |
| 6,527,149 | B1 * | 3/2003 | Garcia et al. | 222/321.9 |
| 6,736,288 | B1 * | 5/2004 | Green | 222/94 |
| 6,796,478 | B2 * | 9/2004 | Shkolnikov et al. | 227/10 |
| 6,923,342 | B2 * | 8/2005 | Bourque et al. | 222/136 |
| 6,971,556 | B2 | 12/2005 | Shadwell et al. | |
| 7,481,334 | B2 * | 1/2009 | Arghyris et al. | 222/137 |
| 7,942,146 | B2 * | 5/2011 | Boeck | 128/200.23 |
| 8,286,941 | B2 * | 10/2012 | Fontela et al. | 251/354 |
| 8,434,648 | B2 * | 5/2013 | Marie et al. | 222/402.1 |
| 8,602,272 | B2 * | 12/2013 | Burel et al. | 222/402.2 |
| 2003/0121935 | A1 * | 7/2003 | Arsenault et al. | 222/1 |

FOREIGN PATENT DOCUMENTS

| | | |
|---|---|---|
| JP | 2004-244109 | 9/2004 |
| JP | 2004-537482 | 12/2004 |
| JP | 2008-100764 | 5/2008 |
| JP | 2009-040464 | 2/2009 |
| WO | WO 2009004270 A2 * | 1/2009 |

* cited by examiner

AEROSOL DEVICE FOR ALLOCATION OF PLURALITY OF FLUIDS

BACKGROUND OF THE INVENTION

The present invention relates to an aerosol device for distributing a plurality of liquids, which is capable of separately packing a plurality of contents in a container and of distributing these contents in separation at least until a passage portion in a stem.

It is conventionally known that, in the case of some coating materials, adhesives, hair dyes, pharmaceutical products, and the like, mixing of two or more different materials produces advantageous technical effects. However, in most cases, mixing needs to be performed just before use because a chemical reaction such as curing or oxidation occurs due to mixing. Therefore, when mixing is performed in an aerosol valve, there are cases where the aerosol valve becomes disabled due to, for example, curing. There also are cases where two or more different materials are preferably distributed to the outside unmixed.

Japanese Patent Application Laid-Open No. 2004-244109 proposes an aerosol device for mixing two different materials, separately packed in two inner bags, in the final stage of ejection, or for ejecting them unmixed. However, because the aerosol device disclosed in Japanese Patent Application Laid-Open No. 2004-244109 is configured to eject two contents after they are separately introduced into an ejection nozzle within one aerosol valve, two passages need to be formed in a valve constituted of small parts. The production of such a valve requires advanced techniques and a lot of effort, which increases product prices and causes problems in product reliability. Therefore, the valve system of an aerosol device is contemplated to be simplified by providing two aerosol valves in an aerosol container to ease production and improve product reliability.

SUMMARY OF THE INVENTION

However, a generally-used standard aerosol container has an inch bead portion with a diameter of 1 inch. Such an aerosol container is called an "inch can" by those skilled in the art. Aerosol containers other than such inch cans are irregular containers, the use of which is disadvantageous because they are more expensive than inch cans.

As described in Japanese Patent Application Laid-Open No. 2008-100764, when one aerosol valve is fitted to an inch can, the outer periphery of a cover having the aerosol valve fixed thereto is fixed to the lower surface of the inch bead portion. This fixation is performed by outwardly expanding an outwardly-expandable hook provided outwards of a rising portion of the cover having the aerosol valve fixed thereto, thereby swaging the outer periphery of the cover onto the lower edge of the inner surface of the inch bead portion, pushing it inside. As described in Japanese Patent Application Laid-Open No. 2008-100764, such an outwardly-expandable hook can be used only when there is a space for inserting and expanding the hook between the outer periphery of the rising portion of the cover having the aerosol valve fixed thereto and the inch bead portion, and the outwardly-expandable hook needs to be inserted into the space.

However, as described above, when two aerosol valves are provided in an aerosol container having an inch bead portion to simplify the valve system of an aerosol device to ease production and improve product reliability, the inner peripheral side of the inch bead portion is filled with the two aerosol valves, and therefore there is no space for inserting an outwardly-expandable hook on the inner peripheral side of the inch bead portion. For this reason, a cover having two aerosol valves fixed thereto cannot be fixed to an aerosol container known as "inch can", which has an inch bead portion with a diameter of 1 inch.

Japanese Patent Application Laid-Open No. 2002-193363 describes an outwardly-expandable hook as if it could be inserted into a space between a bead portion of an aerosol container and a rising portion of a cover having a set of two aerosol valves fixed thereto. However, the bead portion described in Japanese Patent Application Laid-Open No. 2002-193363 is not an inch-size bead portion but an irregular large-size bead portion. This is because it is impossible for current manufacturing techniques to provide a set of two aerosol valves within an inch bead portion having a diameter of 1 inch with a space for inserting an outwardly-expandable hook being provided outside the aerosol valves. Therefore, the invention described in Japanese Patent Application Laid-Open No. 2002-193363 uses an irregular large-size bead portion or can be implemented only on drawings. Assuming a standard can having a cover with a diameter of 1 inch, the invention described in Japanese Patent Application Laid-Open No. 2002-193363 cannot be implemented.

It is therefore an object of the present invention to provide an aerosol device having a set of two aerosol valves easily and cheaply provided in a standard aerosol container having an inch bead portion, in which the set of two aerosol valves are provided in the inch bead portion of the aerosol container so as to be reliably fixed to the inch bead portion of the aerosol container.

In order to achieve the above object, a set of two aerosol valves are provided in an inch bead portion of an aerosol container, and different contents are separately packed in the aerosol container without being mixed. In order to separately pack different contents in the aerosol container without being mixed, these contents are separately packed in two inner bags. These two inner bags containing the different contents are connected to the two aerosol valves, respectively so that the different contents can be separately introduced into the two aerosol valves.

Further, the lower ends of stems of the set of two aerosol valves are inserted into a set of two housings, respectively so that the stem insertion portions of the housings project above the inch bead portion of the aerosol container. Further, the lower end of a fitting member whose inner peripheral shape corresponds to the outer peripheral shape of the set of two housings is fitted and fixed to the inner periphery of the inch bead portion, and the outer periphery of the fitting member is covered with a metallic cover. The set of two stems are allowed to project from the upper end of the cover and the lower end of the cover is fixed to the outer periphery of the inch bead portion, which makes it possible to fix the set of two aerosol valves to the inch bead portion.

Further, the fitting member may have an outer peripheral flange provided on the side surface thereof so as to annularly project around the outer periphery thereof. In this case, the lower surface of the outer peripheral flange is placed on the upper surface of the inch bead portion with a cut rubber being interposed therebetween, and the upper surface of the outer peripheral flange is planarly covered with and fixed by the cover. This makes it possible to prevent the concentration of the pressure of a propellant in the aerosol container on only a top panel section of the cover so that the pressure of the propellant is dispersed also on a part of the cover that planarly covers the upper surface of the outer peripheral flange. This makes it possible to reduce the possibility that the top panel section is deformed due to the concentration of the pressure of the propellant on only the top panel section of the cover and therefore to enhance the pressure resistance of the aerosol device.

Alternatively, the fitting member may be formed without providing the outer peripheral flange. In this case, a cut rubber is placed on the upper surface of the inch bead portion, and the upper surface of the cut rubber is planarly covered with and fixed by the cover. In this case, as compared to the above-described case where the fitting member is provided with the outer peripheral flange, there is a higher possibility that the deformation of the top panel section occurs. However, the deformation of the top panel section is prevented when the fill pressure of a propellant is low or can be prevented by, for example, enhancing the strength of the material of the cover.

Further, the fitting and fixation of the lower end of the fitting member to the inner periphery of the inch bead portion may be performed by inserting and engaging with the inner periphery of the inch bead portion a plurality of engagement pieces, which annularly project from the outer periphery of the fitting member at regular intervals, with a buffer space being provided between the fitting member and the engagement pieces so that the engagement pieces can be elastically deformed. This makes it possible to connect and fit the fitting member and the aerosol container together simply by pushing the engagement piece side of the fitting member into the aerosol container, thereby enabling to easily and quickly perform continuous assembly on assembly lines.

Further, each of the engagement pieces may have a rib provided between the inner peripheral surface thereof and the fitting member so as to be able to respond to a deformation pressure applied to the aerosol container when the cover is fixed to the outer periphery of the inch bead portion. This makes it possible to prevent the deformation of the aerosol container, because the rib responds to a deformation pressure applied to the aerosol container and the fitting member when the cover is fixed to the outer periphery of the inch bead portion by crimping.

Further, the covering of the fitting member with the cover may be performed by allowing a stem gasket, through which the stems penetrate, to lie astride the upper end of the housings and the upper end of the fitting member so that the upper surface of the stem gasket is covered with the top plate section of the cover. This makes it possible to prevent an accident that a propellant leaks from the gap between the outer periphery of any of the housings and the inner periphery of the fitting member via the upper end of the fitting member and the inner surface of the cover.

In this case, the upper end of each of the housings and the upper end of the fitting member, on which the stem gasket is placed, may each have a sealing point annularly formed so as to be buried on the lower surface of the stem gasket. This makes it possible to more reliably prevent the above-described leakage accident.

Further, the outer periphery of a part of the fitting member that covers the housings projecting above the inch bead portion may have a shape formed from two parallel side wall surfaces, along which the cover is formed to cover the fitting member. This makes it possible to use the two parallel side wall surfaces as a reference for alignment in device assembly lines and therefore to achieve efficient and accurate assembly.

Further, two inner bags whose volume expands and contracts may be connected to the lower ends of the set of two housings, respectively so that different contents are packed in these inner bags, respectively. This makes it possible to separately pack two different contents in the aerosol container with reliability and therefore to prevent the accident that the different contents are mixed.

According to the present invention, it is possible to provide an aerosol device having a set of two aerosol valves easily and cheaply provided in a standard aerosol container having an inch bead portion, in which the set of two aerosol valves are provided in the aerosol container so as to be reliably fixed to the inch bead portion of the aerosol container without using an expandable hook.

DETAILED DESCRIPTION OF THE INVENTION

First Embodiment

Embodiments of the present invention will be described with reference to FIGS. 1 to 10. In FIGS. 1 to 10, (1) denotes an aerosol container that is a generally-used standard article having an inch bead portion (2) with a diameter of 1 inch. On the inner peripheral side of the inch bead portion (2), a fitting member (3) is provided. On the inner peripheral side of the fitting member (3), a set of two aerosol valves (4) are provided in parallel in a vertical direction. It is to be noted that in this specification, the vertical and horizontal positional relationships are based on positional relationships in FIG. 1.

Figure 1:
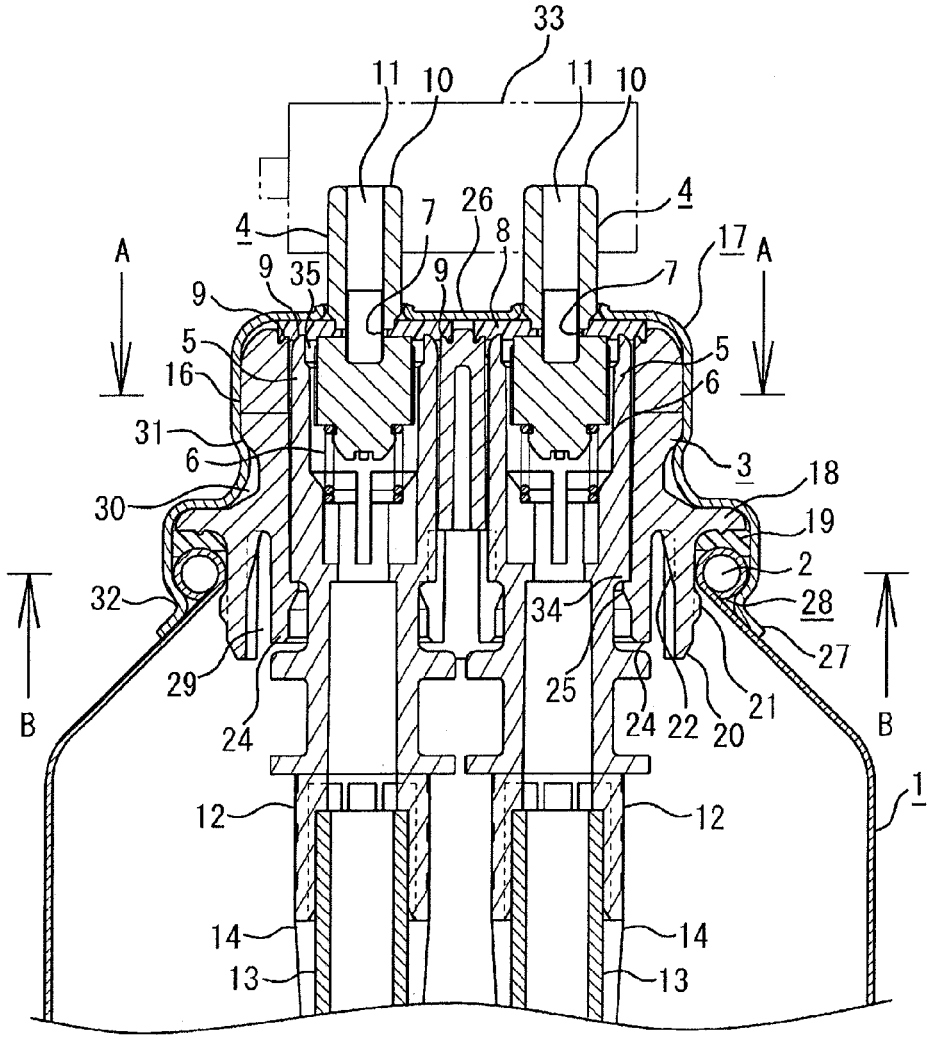
FIG. 1 is a sectional view of an embodiment according to the present invention.

As shown in FIG. 1, each of the aerosol valves (4) has a housing (5) and a stem (10) fitted into the housing (5) so as to be biased outward by a spring (6), with a stem gasket (8) provided around an orifice (7) of the stem (10). The stem gasket (8) lies astride the upper end of the housing (5) and the upper end of the fitting member (3) into which the housing (5) is fitted. By forming the aerosol valve (4) in such a manner as described above, it is possible to prevent an accident that a propellant leaks from a gap between the outer periphery of the housing (5) and the inner periphery of the fitting member (3) via the upper end of the fitting member (3) and the inner surface of a cover (17). The upper end of the housing (5) and the upper end of the fitting member (3) each have a narrow sealing point (9) annularly formed so as to be buried in the stem gasket (8). The sealing points (9) do not always need to be provided, but the above-described leakage accident can be more reliably prevented by providing the sealing points (9).

As shown in FIG. 1, the upper end of each stem (10), having an ejection channel (11) therein, penetrates the stem gasket (8) and projects outward, such that the orifice (7) of the stem (10) is openably and closably sealed with the stem gasket (8). At least a part of the housing (5) in which the stem (10) is inserted projects above the inch bead portion (2). The lower end of the housing (5) is inserted below the inch bead portion (2) of the aerosol container (1), and is formed into a fitting tube (12). A dip tube (13) is fitted to the inner periphery of the lower end of the fitting tube (12). The upper end of an inner bag (14) is fixed to the outer periphery of the lower end of the fitting tube (12) so that the dip tube (13) is inserted into the inner bag (14). In this way, by inserting the dip tube (13) into the inner bag (14), it is possible to prevent content of the inner bag (14) from remaining in the lower part of the inner bag (14) due to the inner bag (14) kinking at its middle or deforming and sticking together at its middle. This makes it possible to completely eject and use the content of the inner bag (14).

Further, the use of the two inner bags (14) makes it possible to separately pack two different aerosol contents in the aerosol container (1) with reliability. The two inner bags (14) separately store a base agent and an additive which constitute an aerosol product such as a hot shaving cream, a hair dye, an adhesive, a coating material, or a pharmaceutical product and which cause an undesirable chemical reaction such as curing or oxidation if mixed in advance.

Figure 2:
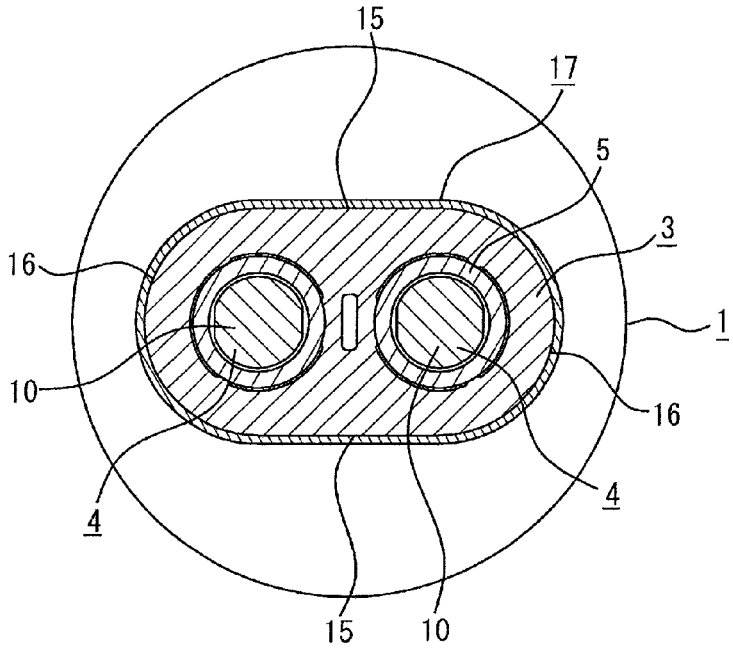
FIG. 2 is a sectional view taken along the A-A line in FIG. 1.
Figure 9:
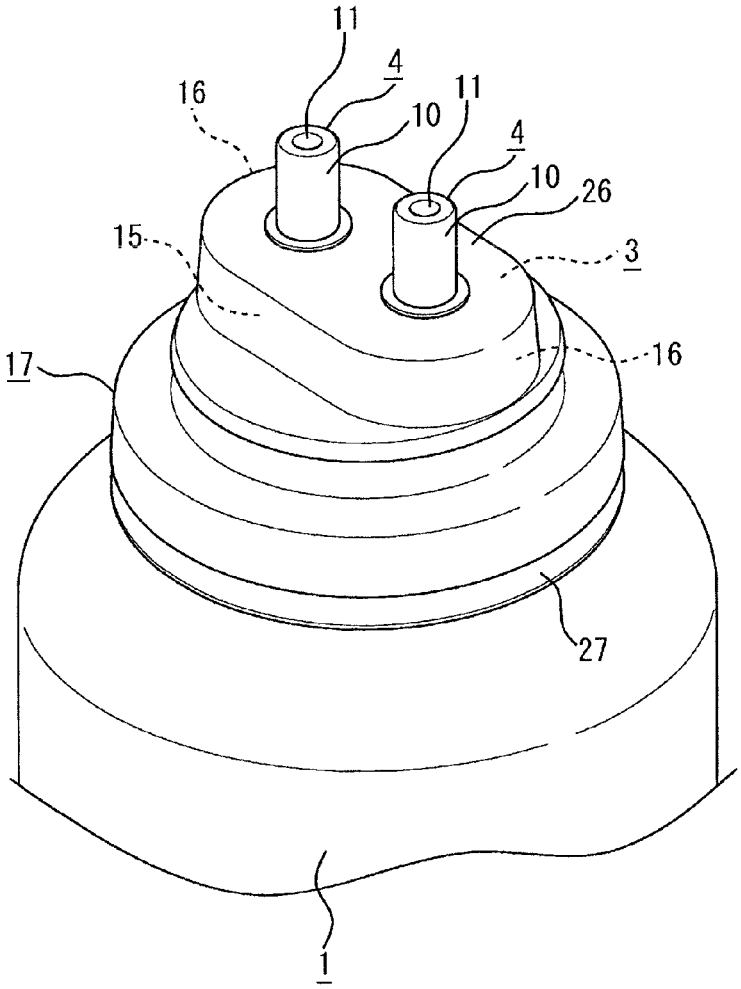
FIG. 9 is a perspective view of the embodiment according to the present invention.

As shown in FIGS. 1, 2, and 9, the fitting member (3) whose inner peripheral shape corresponds to the outer peripheral shape of the set of two housings (5) is provided around the outside of the housings (5) of the aerosol valves (4). The lower end of the fitting member (3) is engaged with and fixed to the inner periphery of the inch bead portion (2). The outer periphery of a part of the fitting member (3) that covers the housings (5) projecting above the inch bead portion (2) has an elliptical shape formed from two parallel side wall surfaces (15) and two arc surfaces (16) each connecting the side wall surfaces (15) together. The cover (17) is formed so as to cover the fitting member (3) along the parallel side wall surface (15) and the arc surfaces (16). By providing such parallel side wall surfaces (15) also on the outer surface of the cover (17), it is possible to use the two parallel side wall surfaces (15) as a reference for alignment in device assembly lines to achieve efficient and accurate assembly.

Figure 3:
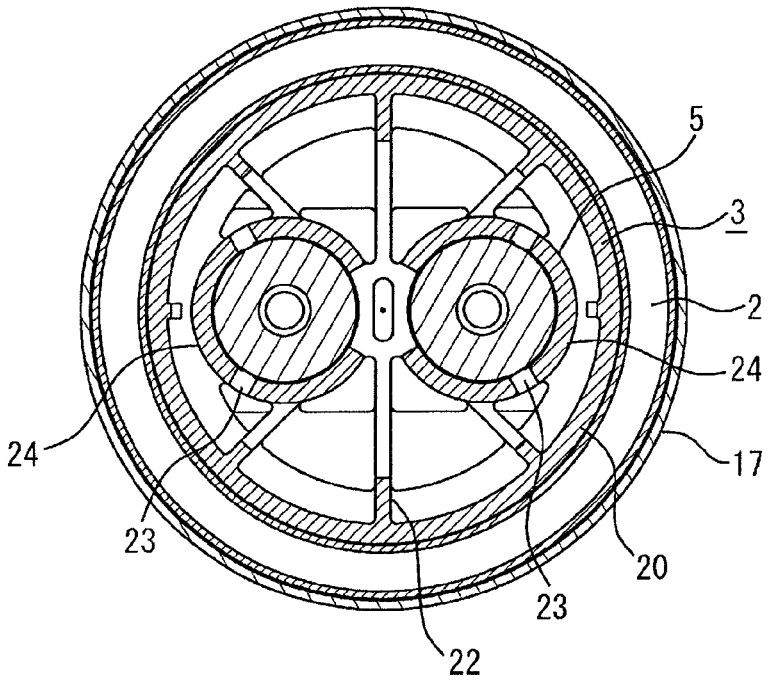
FIG. 3 is a sectional view taken along the B-B line in FIG. 1.
Figure 4:
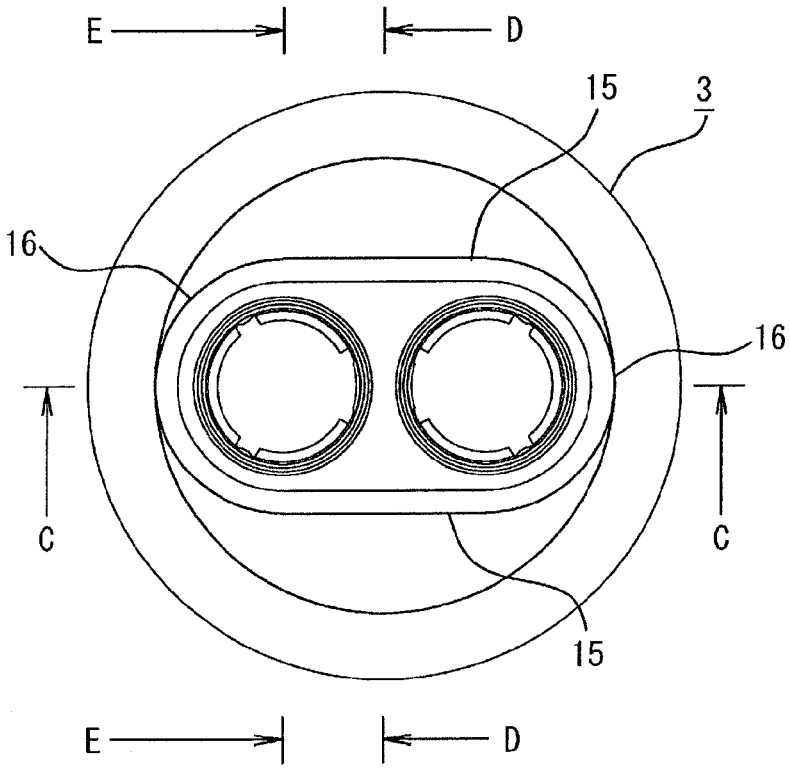
FIG. 4 is a plan view of a fitting member.
Figure 5:
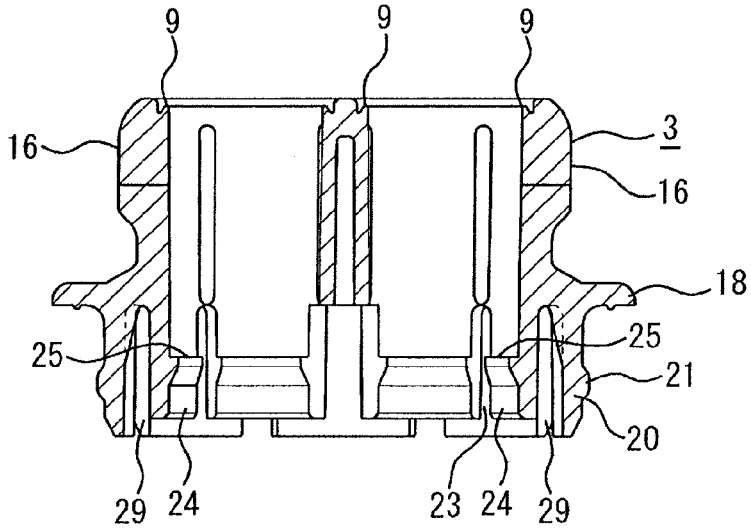
FIG. 5 is a sectional view taken along the C-C line in FIG. 4.
Figure 6:
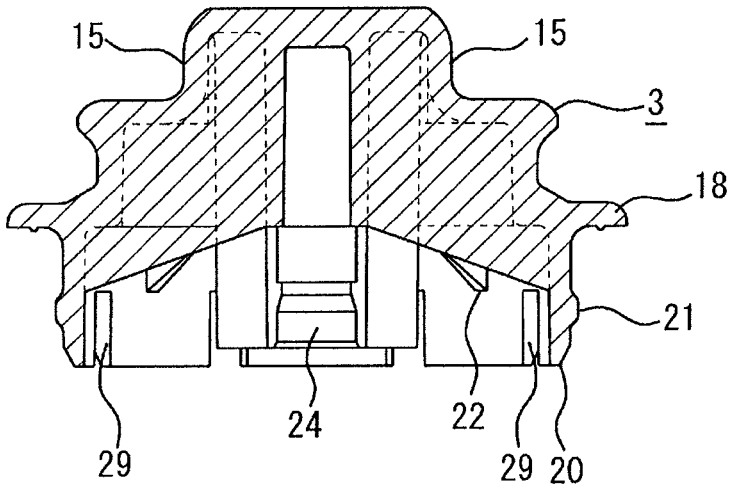
FIG. 6 is a sectional view taken along the D-D line in FIG. 4.
Figure 7:
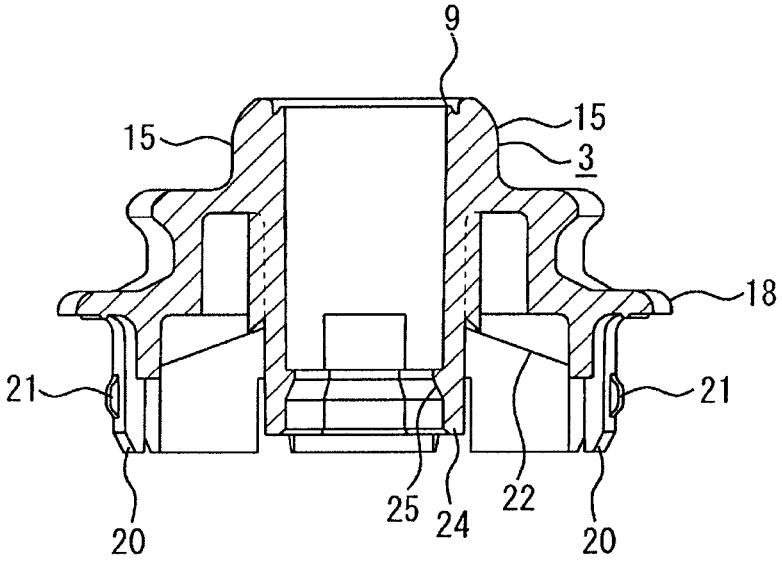
FIG. 7 is a sectional view taken along the E-E line in FIG. 4.
Figure 8:
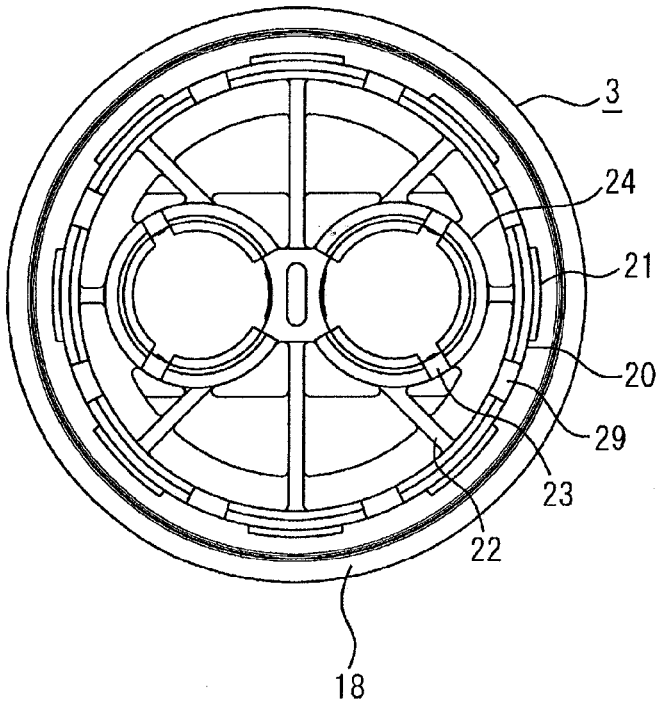
FIG. 8 is a bottom view of the fitting member.

The fitting member (3) is fitted to the inch bead portion (2) by a plurality of engagement pieces (20) to be engaged with the inner periphery of the inch bead portion (2). The engagement pieces (20) project from the lower surface of an outer peripheral flange (18) that projects from the outer periphery of the fitting member (3). A buffer space (29) is provided between the fitting member (3) and the engagement pieces (20) so that the engagement pieces (20) can be elastically deformed. Further, each of the engagement pieces (20) has an engagement projection (21) that projects from the outer periphery thereof so as to be engaged with the lower surface of the inch bead portion (2). On the upper surface of the inch bead portion (2), a cut rubber (19) is placed. The fitting member (3) is fixed by placing the outer peripheral flange (18), projecting from the outer periphery of the fitting member (3), on the upper surface of the cut rubber (19) and by pushing the engagement pieces (20) into the inch bead portion (2) and engaging them with the inch bead portion (2). The engagement pieces (20) project from the lower surface of the outer peripheral flange (18), provided as apart of the fitting member (3), at regular intervals so as to be elastically deformable, and as shown in FIGS. 1 and 3, each of the engagement pieces (20) has a rib (22) provided on the inner side thereof so as to be in contact with the lower surface of the outer peripheral flange (18). Each of the ribs (22) is configured to be able to respond to a deformation pressure applied to the aerosol container (1) when the cover (17) is fixed to the outer periphery of the inch bead portion (2). Therefore, when the cover (17) is fixed to the outer periphery of the inch bead portion (2) by crimping, the ribs (22) can respond to a deformation pressure applied to the aerosol container (1) and the fitting member (3) to prevent deformation. However, the lower end side of each of the engagement pieces (20) can be elastically deformed.

Further, a fitting piece (24) annularly projects from the lower end of the fitting member (3) around the outside of each of the housings (5). Each of the fitting pieces (24) has a plurality of slits (23) provided in the axial direction thereof so as to be elastically deformable, and an engagement projection (25) provided in the inner surface thereof so as to be engaged with an engagement step (34) of the housing (5). The fitting piece (24) is pushed outward by inserting the housing (5) thereinto, which enables the housing (5) and the fitting member (3) to be connected together.

Further, as shown in FIGS. 1 and 9, the outer periphery of the fitting member (3) is covered with the cover (17) made of a metallic material to fix the fitting member (3) and the aerosol valves (4) to the aerosol container (1). The cover (17) includes a top panel section (26) provided as a planar section on the upper surface of the stem gaskets (8) to enhance pressure resistance, and a part of each of the stems (10) having the ejection channel (11) formed therein projects above the top panel section (26). The cover (17) is fixed by crimping a lower foot portion (27) onto a lower end portion (28) of the inch bead portion (2). At the same time, a vertically-middle section (30) of the cover (17) is crimped onto the lower surface of an engagement step (31) provided in the outer periphery of the fitting member (3) to reliably fix the fitting member (3), the housings (5), the stems (10), the stem gaskets (8), etc. to the aerosol container (1) to prevent misalignment during production or use.

However, it is not always necessary to crimp the vertically-middle section (30) of the cover (17) onto the engagement step (31) provided in the outer periphery of the fitting member (3) in a case where the lower end portion of the cover (17) can be reliably fixed to the lower end of the inch bead portion (2) by a crimp portion (32). By crimping the cover (17) onto the engagement step (31) provided in the outer periphery of the fitting member (3), it is possible to reliably press the top plate section (26) of the cover (17) against the stem gaskets (8) to enhance sealability. Further, by crimping the cover (17) onto the engagement step (31) provided in the outer periphery of the fitting member (3), it is possible to fix the cover (17) at two upper and lower positions, which eliminates a possibility that misalignment of the cover (17) occurs or sealing defects are caused even when fixation of the lower end portion of the cover (17) to the lower end of the inch bead portion (2) by the crimp portion (32) varies in quality or a finally-obtained aerosol device is roughly handled when used.

The components each having such a structure as described above are assembled in the following manner. First, the cut rubber (19) is placed on the lower surface of the outer peripheral flange (18) of the fitting member (3). Then, the dip tube (13) is connected to the inner periphery of the lower end of the fitting tube (12) of each of the housings (5). The inner bag (14) is fitted to the outer periphery of each of the dip tubes (13) so as to be fixed and connected to the outer periphery of the lower end of the fitting tube (12). Then, each of the housings (5) is inserted into the fitting member (3) from the fitting piece (24) side so that the engagement projection (25) of the fitting piece (24) is engaged with the engagement step (34) provided in the outer periphery of the housing (5). Then, the stem (10) having the stem gasket (8) and the spring (6) fitted thereto is fitted to each of the housings (5) so that the spring (6) biases the stem (10) outward and the stem gasket (8) is placed at an upper opening (35) of the housing (5). Then, the fitting member (3) is fitted to the aerosol container (1).

The fitting member (3) is fitted to the aerosol container (1) in the following manner. The cut rubber (19) is allowed to face the upper surface of the inch bead portion (2), and the engagement pieces (20) that project from the lower surface of the outer peripheral flange (18) of the fitting member (3) are brought into contact with the upper surface of the inner periphery of the inch bead portion (2) in a state where a space for filling a propellant is provided between the upper surface of the inch bead portion (2) and the cut rubber (19). In this state, the outer periphery of the fitting member (3) fitted to the inch bead portion (2) of the aerosol container (1) is covered with the cover (17) made of a metallic material so that the two stems (10) project from the top plate section (26) of the cover (17). In this way, the outer periphery of the fitting member (3) is covered with the cover (17), but the engagement pieces (20) are only in contact with the upper surface of the inner periphery of the inch bead portion (2) because crimping between the cover (17) and the inch bead portion (2) of the aerosol container (1) has not yet been performed.

Then, a conventionally-known propellant filling head (not shown) is placed around the outside of the cover (17) to fill a propellant such as nitrogen gas into the aerosol container (1) through the gap between the inch bead portion (2) of the aerosol container (1) and the fitting member (3). At the same time of completion of filling of the propellant into the aerosol container (1), the upper surface of the fitting member (3) is pressed to push the fitting member (3) into the aerosol container (1) so that the engagement projections (21) of the engagement pieces (20) are pressed against and engaged with the lower surface of the inch bead portion (2). This engagement makes it possible to press the outer peripheral flange (18) of the fitting member (3) against the upper surface of the cut rubber (19). Further, at the same time, the lower end of the cover (17) is fixed to the outer periphery of the inch bead portion (2) by the crimp portion (32). Fixing the cover (17) to the inch bead portion (2) by means of the crimp portion (32) enables to stably fix the fitting member (3), the housings (5), the stems (10), the stem gaskets (8), etc. to the aerosol container (1). After the completion of the above-described filling of the propellant and assembly of the components, different liquid contents are separately filled into the inner bags (14) through the stems (10) by the through-the-valve method.

In the above-described state where the fitting member (3) having the housings (5), each having the stem (10) inserted therein, fitted thereto is fitted and fixed to the aerosol container (1), the stem (10) insertion portions of the housings (5) project above the inch bead portion (2) of the aerosol container (1). By allowing the stem (10) insertion portions of the housings (5) to project above the inch bead portion (2), the stem (10) insertion portions of the two parallel-arranged housings (5) are not constrained by the inch bead portion (2) whose diameter is 1 inch. Therefore, by covering the housings (5) projecting above the inch bead portion (2) with the cover (17) and fixing the lower end of the cover (17) to the inch bead portion (2) by the crimp portion (32), it is possible to easily connect and fix the housings (5) to the aerosol container (1). This makes it possible to connect two independent valve systems to the aerosol container (1) with the inch bead portion (2), which is a conventional standard container, and therefore to cheaply obtain the aerosol container having the two valve system.

Alternatively, before the fitting member (3) is fitted to the aerosol container (1), that is, after the housings (5) each having the stem (10), having the spring (6) and the stem gasket (8) connected thereto, inserted therein are fitted to the fitting member (3), the outer periphery of the fitting member (3) may be covered with the cover (17) by crimping only the middle section of the cover (17) onto the engagement step (31). By fixing the middle section of the cover (17), it is possible to stably fix the stems (10), the housings (5), the fitting member (3), etc. and therefore to easily fix the fitting member (3) to the aerosol container (1). Then, the fitting member (3) having the stems (10), the housings (5), etc. fixed thereto is fitted to the inch bead portion (2) of the aerosol container (1), and then the lower end of the cover (17) is crimped onto the inch bead portion (2) to complete the fixation of the fitting member (3) to the aerosol container (1).

In this case, the fitting member (3) is fixed to the aerosol container (1) after small components such as the stems (10), the springs (6), the stem gaskets (8), and the housings (5) are fixed to the fitting member (3) by the cover (17). Therefore, it is possible to quickly and stably fix the fitting member (3) to the aerosol container (1). However, the number of processes is larger as compared to the above-described case where the fitting member (3) having the stems (10), the housings (5), etc. fitted thereto is fitted to the inch bead portion (2) of the aerosol container (1) and is then covered with and fixed by the cover (17).

A push button (33) is connected to the set of two stems (10). The two different contents may be ejected after they are mixed in the push button (33) or may be separately ejected. Therefore, the push button (33) can be arbitrarily selected depending on the intended use of the aerosol device.

According to this embodiment, the fitting member (3) has the outer peripheral flange (18) provided on the side surface thereof so as to annularly project around the outer periphery thereof, the lower surface of the outer peripheral flange (18) is placed on the upper surface of the inch bead portion (2) with the cut rubber (19) being interposed therebetween, and the upper surface of the outer peripheral flange (18) is planarly covered with and fixed by the cover (17), which makes it possible to prevent the concentration of the pressure of a propellant in the aerosol container (1) on only the top plate section (26) of the cover (17). That is, the aerosol device according to this embodiment is configured so that the pressure of a propellant is dispersed also on a part of the cover (17) that planarly covers the upper surface of the outer peripheral flange (18). Therefore, it is possible to reduce the possibility that the deformation of the top plate section (26) occurs due to the concentration of the pressure of a propellant on only the top plate section (26) of the cover (17), thereby enhancing the pressure resistance of the aerosol device.

Second Embodiment

Figure 10:
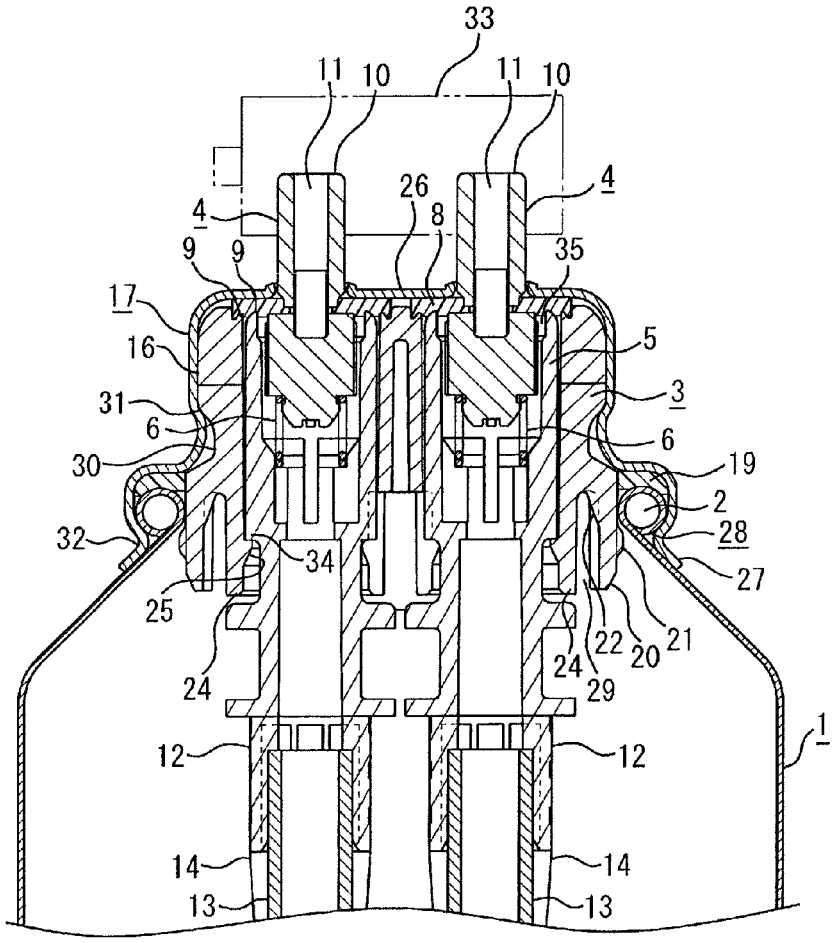
FIG. 10 is a sectional view of another embodiment according to the present invention in which an outer peripheral flange is not provided.

According to a second embodiment of the present invention, as shown in FIG. 10, the fitting member (3) is formed without providing the outer peripheral flange (18), the cut rubber (19) is placed on the upper surface of the inch bead portion (2), and the upper surface of the cut rubber (19) is planarly covered with and fixed by the cover (17). In this case, as compared to the first embodiment provided with the outer peripheral flange (18), there is a higher possibility that deformation of the top plate section (26) occurs. However, deformation of the top plate section (26) is prevented when the fill pressure of a propellant is low or can be prevented by, for example, enhancing the strength of the material of the cover (17).

The invention claimed is:

1. An aerosol device for distributing a plurality of liquids, comprising:

an aerosol container having an inch bead portion;

a set of two aerosol valves, each of which has a stem and a housing and is provided in the inch bead portion of the aerosol container;

a fitting member whose inner peripheral shape corresponds to an outer peripheral shape of the set of two housings so that it supports the housings of respective stem insertion portions of the set of two aerosol valves by projecting above the inch bead portion; and a cover in which an outer periphery of the fitting member is covered so that respective stems of the two aerosol valves project from an upper end of the cover, and a lower end of the cover is fixed to an outer periphery of the inch bead portion, wherein the fitting member comprises a plurality of axially-extending circumferentially-spaced elastically-deformable engagement pieces that engage the container at the inch bead portion, the plurality of engagement pieces being mounted annularly in a circumferential direction of the aerosol container, each one of the plurality of engagement pieces configured to have a buffer space circumferentially to each side resulting in a plurality of buffer spaces circumferentially alternating with the plurality of engagement pieces;

wherein each one of the plurality of the engagement pieces comprises an outward facing surface having a projecting portion located along a first portion of the outward facing surface, the projecting portion being configured to engage with a lower surface of the inch bead portion, a second portion of the outward facing surface, adjacent to said first portion, being configured to contact an inwardmost surface of the inch bead portion;

wherein the fitting member further comprises a plurality of axially-extending circumferentially-spaced elastically-deformable fitting pieces, each one of the fitting pieces engaging at least one of the housings to secure the aerosol valves to the fitting member, the plurality of fitting pieces being located radially inward of and radially spaced from the plurality of engagement pieces; and wherein each one of the plurality of axially-extending, circumferentially-spaced, elastically-deformable fitting pieces has an engagement projection extending radially inward to a respective first radial position, and is configured so that such first radial inward position is a deformed position resulting from being pushed radially outward when the set of two aerosol valves is fitted into the fitting member.

2. The aerosol device for distributing a plurality of liquids according to claim 1, wherein the fitting member has an outer peripheral flange provided on a side surface thereof so as to annularly project around the outer periphery thereof, and wherein a lower surface of the outer peripheral flange is placed on an upper surface of the inch bead portion with a cut rubber being interposed therebetween, and an upper surface of the outer peripheral flange is planarly covered with and fixed by the cover.

3. The aerosol device for distributing a plurality of liquids according to claim 1, wherein each of the engagement pieces has a rib provided between an inner peripheral surface thereof and the fitting member so as to be adapted to respond to a deformation pressure applied to the aerosol container when the cover is fixed to the outer periphery of the inch bead portion.

4. The aerosol device for distributing a plurality of liquids according to claim 1, wherein the covering of the fitting member with the cover is performed by allowing a stem gasket, through which each of the stems penetrates, to lie astride an upper end of the housing and an upper end of the fitting member so that an upper surface of the stem gasket is covered with a top plate section of the cover.

5. The aerosol device for distributing a plurality of liquids according to claim 4, wherein the upper end of each of the housings and the upper end of the fitting member, on which the stem gasket is placed, each have a sealing point annularly provided so as to be buried on a lower surface of the stem gasket.

6. The aerosol device for distributing a plurality of liquids according to claim 1, wherein the outer periphery of a part of the fitting member that covers the housings projecting above the inch bead portion has a shape formed from two parallel side wall surfaces, along which the cover is formed to cover the fitting member.

7. The aerosol device for distributing a plurality of liquids according to claim 1, 4, 5, or 6, wherein two inner bags whose volume expands and contracts are connected to lower ends of the set of two housings, respectively so that different contents are packed in these inner bags, respectively.

* * * * *